US010479962B2

(12) United States Patent
Sunder et al.

(10) Patent No.: US 10,479,962 B2
(45) Date of Patent: Nov. 19, 2019

(54) SOLID COMPOSITION FOR TEXTILE TREATMENT

(71) Applicant: Henkel AG & Co. KGaA, Duesseldorf (DE)

(72) Inventors: Matthias Sunder, Duesseldorf (DE); Patrick Bueth, Ratingen (DE); Sheila Edwards, Duesseldorf (DE); Frank Meier, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 138 days.

(21) Appl. No.: 15/512,298

(22) PCT Filed: Sep. 18, 2015

(86) PCT No.: PCT/EP2015/071442
§ 371 (c)(1),
(2) Date: Mar. 17, 2017

(87) PCT Pub. No.: WO2016/042128
PCT Pub. Date: Mar. 24, 2016

(65) Prior Publication Data

US 2017/0275574 A1 Sep. 28, 2017

(30) Foreign Application Priority Data

Sep. 19, 2014 (DE) ..... 10 2014 218 950

(51) Int. Cl.

| | |
|---|---|
| ***C11D 1/00*** | (2006.01) |
| ***C11D 11/00*** | (2006.01) |
| ***C11D 3/10*** | (2006.01) |
| ***C11D 3/39*** | (2006.01) |
| ***C11D 17/04*** | (2006.01) |
| ***C11D 3/20*** | (2006.01) |
| *C11D 7/12* | (2006.01) |

(52) U.S. Cl.
CPC ..... *C11D 11/0017* (2013.01); *C11D 3/10* (2013.01); *C11D 3/2086* (2013.01); *C11D 3/2093* (2013.01); *C11D 3/391* (2013.01); *C11D 3/3905* (2013.01); *C11D 3/3907* (2013.01); *C11D 17/045* (2013.01); *C11D 7/12* (2013.01)

(58) Field of Classification Search
None
See application file for complete search history.

(56) References Cited

U.S. PATENT DOCUMENTS

| | | | | |
|---|---|---|---|---|
| 4,116,885 | A | 9/1978 | Derstadt et al. | |
| 5,142,020 | A | 8/1992 | Kud et al. | |
| 2009/0137448 | A1 | 5/2009 | Leininger et al. | |
| 2015/0291917 | A1* | 10/2015 | Eiting ..... | C11D 3/38609 435/264 |

FOREIGN PATENT DOCUMENTS

| | | | |
|---|---|---|---|
| EP | 0066944 | A1 | 12/1982 |
| EP | 0185427 | A2 | 6/1986 |
| EP | 0241984 | A2 | 10/1987 |
| EP | 0241985 | A2 | 10/1987 |
| EP | 0253567 | A1 | 1/1988 |
| EP | 0272033 | A2 | 6/1988 |
| EP | 0274907 | A1 | 7/1988 |
| EP | 0357280 | A2 | 3/1990 |
| EP | 0427314 | A2 | 5/1991 |
| EP | 1227063 | A2 | 7/2002 |
| EP | 2527421 | A1 | 11/2012 |
| GB | 2165856 | A | 4/1986 |

OTHER PUBLICATIONS

EPO, International Search Report and Written Opinion issued in International Application No. PCT/EP2015/071442, dated Jan. 20, 2016.

* cited by examiner

*Primary Examiner* — Necholus Ogden, Jr.
(74) *Attorney, Agent, or Firm* — Lorenz & Kopf, LLP

(57) ABSTRACT

Solid compositions for use in textile treatment, each comprising, based on the total weight of the solid composition, a total amount of each of —30% to 70% by weight of at least one peroxide compound, —10% to 20% by weight of at least one organic bleach activator, —5% to 50% by weight of hydrogencarbonate, calculated as sodium hydrogencarbonate, —0% to 5% by weight of surfactant, where the total amount of organic compound in the solid composition is 10% to 50% by weight, preferably 20% to 35% by weight, are thermally stable and can be stored reliably. They are suitable as an additive to conventional textile treatment compositions, especially to liquid washing compositions, and can be provided as a portion encased with a water-soluble material.

10 Claims, No Drawings

SOLID COMPOSITION FOR TEXTILE TREATMENT

CROSS-REFERENCE TO RELATED APPLICATION

This application is a U.S. National-Stage entry under 35 U.S.C. § 371 based on International Application No. PCT/EP2015/071442, filed Sep. 18, 2015, which was published under PCT Article 21(2) and which claims priority to German Application No. 10 2014 218 950.0, filed Sep. 19, 2014, which are all hereby incorporated in their entirety by reference.

TECHNICAL FIELD

The present disclosure relates to the technical field of textile treatment, in particular for the treatment of textiles, in particular for cleaning textiles and/or washing textiles.

BACKGROUND

For cleaning textiles, those skilled in the art know about various suitable active substances which, used as additives in washing agents, for example, produce the targeted removal or reduced perception of dirt. For example, those skilled in the art will differentiate for this purpose dirt that is eliminated primarily by surfactants from dirt that can be removed with the help of enzymes or bleaching agents, for example.

The quality of the removal of bleachable soiling, such as colored fruit and vegetable spots forms a central quality feature of a detergent. During the bleaching, the bleachable dirt should be bleached out and/or removed, on the one hand, but on the other hand, the textile should not be damaged by the bleach.

However, bleaching agents that are stable in storage, when incorporated as an active ingredient into solid washing agents, are not stable in liquid washing agents. Liquid washing agents are increasingly preferred by consumers, and the market share of liquid washing agents is growing. Because of the aforementioned stability problem with bleaching agents in liquid washing agents, a solid bleaching agent composition may be a logical supplement for use in liquid washing agents.

A solid bleaching agent composition that can be used as an additive should contain only a few additional ingredients in addition to the active bleaching compound in order to have conservative use of resources. For packaging of a solid bleaching agent additive in a water-soluble wrapping as a dosing unit, it is advantageous if said bleaching agent additive takes up a small volume. Economization with regard to additional ingredients and a reduction in the volume of the total composition necessarily lead to a high concentration of active bleaching compound.

Use of a large amount of bleach-active compound by weight, combined with the presence of organic compounds, results in instability of the bleaching agent, even in solid compositions. It has been found that a solid composition containing bleaching agent, for example peroxide compounds, in the amount of at least about 30% by weight is thermally unstable on coming in contact with organic compounds, in particular at storage temperatures above about 35° C., and decomposes with an evolution of heat.

Despite these stability problems, it is impossible to completely eliminate additional organic compounds as active ingredients for supplying a bleaching agent additive that is effective on textiles. At least the combination of active bleach compounds (in particular inorganic) with organic bleach activators and/or organic antiredeposition agents (in particular polysaccharide antiredeposition agents) is necessary. Those skilled in the art understand bleach activators to be chemical compounds, which increase the bleaching effect in the presence of peroxide compounds. In a solid bleaching agent composition, the organic bleach activators are in contact with an increased concentration of the active bleach compound, which results in a thermal instability.

The same problem can arise in packaging said bleaching agent additive as a single dose in a portion wrapped in a water-soluble material. The water-soluble wrapping material usually contains organic compounds, which also come in contact with the concentrated solid bleaching agent additive. The object has therefore been to supply portions as a single-use dose that is stable in storage, so that solid compositions have a high concentration of at least one peroxide compound and at least one organic bleach activator in combination with at least one polysaccharide. Furthermore, it is desired to supply portions as a dosing unit that would be stable in storage for the treatment of textiles and would contain a combination of said solid composition with a liquid textile treatment composition in a water-soluble wrapping. On coming in contact with water, said compositions are released from the portion functioning as a dosage unit.

In addition, the solid composition with a high bleaching agent content should be gentle on the textiles and should improve the washing performance of washing agents, in particular liquid washing agents as an additive within the context of a textile washing.

BRIEF SUMMARY

Solid compositions for use in treatment of textiles, portions for use in treatment of textiles including the solid compositions, and methods for treatment of textiles using the solid compositions are provided herein. In an embodiment, a solid composition for use in treatment of textiles is provided. The solid composition includes, each based on the total weight of the solid composition, a total amount of:

- from about 30% to about 70% by weight of at least one peroxide compound,
- from about 10% to about 20% by weight of at least one organic bleach activator,
- from about 5% to about 50% by weight of a hydrogen carbonate, calculated as sodium hydrogen carbonate,
- from 0 to about 5% by weight surfactant, wherein the total amount of organic compound in the solid composition amounts to from about 10% to about 50% by weight.

In another embodiment a portion for use in treatment of textiles is provided. The portion includes at least two chambers with walls made of a water-soluble material. At least one of the chambers includes a first composition. The first composition includes at least one surfactant. At least one additional one of the chambers includes a second composition. The second composition includes, each based on the total weight of the second composition, a total amount of:

- from about 30% to about 70% by weight of at least one peroxide compound,
- from about 10% to about 20% by weight of at least one organic bleach activator,
- from about 5% to about 50% by weight of a hydrogen carbonate, calculated as sodium hydrogen carbonate, from 0 to about 5% by weight surfactant, wherein the total amount of organic compound in the second composition amounts to from about 10% to about 50% by weight.

In another embodiment, a method for treatment of textiles is provided. The method includes the step of dosing a composition for producing a wash liquor that comprises water. The composition further includes, each based on the total weight of the composition, a total amount of:

from about 30% to about 70% by weight of at least one peroxide compound, from about 10% to about 20% by weight of at least one organic bleach activator, from about 5% to about 50% by weight of a hydrogen carbonate, calculated as sodium hydrogen carbonate, from 0 to about 5% by weight surfactant, wherein the total amount of organic compound in the second composition amounts to from about 10% to about 50% by weight, and The method further includes bringing the resulting wash liquor in contact with textiles.

DETAILED DESCRIPTION

The following detailed description is merely exemplary in nature and is not intended to limit the cleaning agents and methods for cleaning dishes using the cleaning agents. Furthermore, there is no intention to be bound by any theory presented in the preceding background or the following detailed description.

It has been found that in supplying a single dose, use of alkali silicate compounds in the solid bleaching agent composition containing polysaccharide has a stabilizing effect on the liquid composition in said portion. The development of a bad odor is prevented. An increase in washing performance is achieved.

A first subject matter as contemplated herein is therefore a solid composition for use in the treatment of textiles, containing a total amount of the following, each based on the total weight of the solid composition:

from about 30% to about 70% by weight of at least one peroxide compound, from about 10% to about 20% by weight of at least one organic bleach activator, from about 5% to about 50% by weight sodium hydrogen carbonate, from 0% to about 5% by weight surfactant, wherein the total amount of organic compound in the solid composition is from about 10 to about 50% by weight.

The solid composition may also contain additional optical ingredients beyond the ingredients necessarily present. The total amounts are selected from the predetermined quantitative weight ranges, such that, together with the amounts of optional ingredients, the result is 100% by weight for said solid composition, based on its total weight.

A composition is solid as contemplated herein if it is present in a solid state at 25° C. and 1013 mbar.

As contemplated herein, a composition is liquid when it is present in a liquid state at 25° C. and 1013 mbar.

A chemical compound is an organic compound if the molecule of the chemical compound contains at least one covalent bond between carbon and hydrogen.

As the converse of the definition of an organic compound, a chemical compound is an inorganic compound if the molecule of the chemical compound does not contain a covalent bond between carbon and hydrogen. This definition applies, mutatis mutandis, to inorganic peroxide compounds as the chemical compound among other things.

A peroxide compound is a chemical compound which contains as a structural fragment the peroxo atomic group —O—O—.

Unless explicitly stated to the contrary, the average molecular weights specified for polymeric ingredients within the context of this patent application are always weight-average molecular weights $M_w$ which can basically be determined by means of gel permeation chromatography with the help of an RI detector, wherein the measurement is expediently made against an external standard.

It has also proven to be preferred if the solid composition as contemplated herein is formed from several solid particles. Such an embodiment of the solid composition is preferably in the form of a powder or granules. Said solid particles in turn preferably have a particle diameter $X_{50.3}$ (volume average) of from about 100 to about 1500 μm. These particle sizes can be determined by screening or by using a Camsizer particle size analyzer from the Retsch Co.

The solid composition as contemplated herein necessarily contains a defined amount of peroxide compound. It has been found to be preferred as contemplated herein if the solid composition as contemplated herein contains, based on the total weight of the composition, peroxide compounds in a total amount of from about 30 to about 50% by weight, in particular from about 33 to about 45% by weight.

It is preferred as contemplated herein if the peroxide compound is selected from at least one inorganic peroxide compound.

In particular, percarbonate compounds, perborate compounds, peroxodisulfate compounds, hydrogen peroxide, addition compounds of hydrogen peroxide onto inorganic compounds, organic peroxy acids or mixtures of at least two of these compounds can be listed as suitable peroxide compounds. It is especially preferred as contemplated herein if the peroxide compound is selected from sodium percarbonate, sodium perborate, sodium peroxodisulfate or mixture thereof. Sodium percarbonate is a most especially preferred peroxide compound. Sodium percarbonate is an addition compound of hydrogen peroxide onto sodium carbonate with the formula $yNa_2CO_3.xH_2O_2$, where x denotes the amount of hydrogen peroxide per y mol $Na_2CO_3$. The peroxide compound $Na_2CO_3.1.5H_2O_2$ with the CAS number 15630-89-4 is the most preferred.

The peroxide compound used as contemplated herein preferably has as contemplated herein an active oxygen content between about 9.0% and about 15.0%, in particular from about 10.0% to about 14.0% (each measured by titration with the potassium permanganate).

For solving the problem as contemplated herein, it has been found to be preferable if the peroxide compound is in the form of particles, in particular in the form of a powder or granules. It is in turn preferred if the particles containing the peroxide compound (for example, the powder or granules) have a bulk density of from about 0.70 to about 1.30 $kg/dm^3$, especially preferably a bulk density of from about 0.85 to about 1.20 $kg/dm^3$ (each measured according to ISO 697).

In addition, such peroxide compounds whose particles have an average particle size (volume average) $X_{50.3}$ of from about 0.40 to about 0.95 mm, in particular of from about 0.50 to about 0.90 mm are preferably suitable (for example, measured by screen analysis or by using a Camsizer particle size analyzer from the Retsch Co.).

A solid peroxide compound, in particular sodium percarbonate, may be provided with a coating for additional protection against decomposition at the surface. This coating should protect the percarbonate from decomposition. Suitable coating agents include preferably water-soluble passivating agents such as, for example, sodium hydrogen carbonate, sodium carbonate, sodium sulfate or metaborate compounds. It may be preferable as contemplated herein if the solid peroxide compound, in particular sodium percarbonate, is coated at least with sodium sulfate at the surface. It is preferable as contemplated herein if the solid peroxide compound has an average particle size $X_{50.3}$ of from about 0.40 to about 0.95 mm, in particular of from about 0.50 to about 0.90 mm (e.g., measured by screen analysis or by using a Camsizer particle size analyzer from the Retsch Co.) and if the particles are coated with sodium sulfate.

Sodium percarbonate particles with a sodium bicarbonate coating obtainable by means of a surface reaction as well as production thereof in a fluidized bed reactor are processes familiar to those skilled in the art from the publication EP 1 227 063 A2. However, said sodium bicarbonate coatings are not desirable in production because of additional technical process steps involving an energy input.

To additionally increase the storage stability of the composition as contemplated herein, the peroxide compound used may be coated with a phlegmatizing agent, in particular with a metaborate compound (the composition as contemplated herein advantageously contains from about 50% to about 100% by weight, based on the peroxide compound content, metaborate-coated peroxide compound) with phlegmatization (i.e., reduction in or prevention of possible heat developing due to exothermic decomposition of the solid peroxide compound). However, the phlegmatizing coating of the solid peroxide compound is not absolutely necessary.

The composition as contemplated herein necessarily contains a total amount of from about 10% to about 20% by weight of one or more organic bleach activators. It is preferable if the subject compositions contain a total amount of from about 11 to about 18% by weight, especially preferably of from about 12 to about 16% by weight, again preferably of from about 10 to about 15% by weight, most especially preferably of from about 11% to about 1% by weight.

The organic bleach activators that are used are preferably compounds that yield, under perhydrolysis conditions, percarboxylic acids (in particular aliphatic peroxycarboxylic acids preferably with 1 to 10 carbon atoms, in particular 2 to 4 carbon atoms) and/or optionally substituted perbenzoic acid. The aforementioned total amounts are also applicable, mutatis mutandis, to these special organic bleach activators.

Perhydrolysis is a reaction with which those skilled in the art are familiar and in which an anion $^{-}$R—O—O—H binds covalently to a reactant R—X by nucleophilic substitution in a protic solvent (e.g., water) while retaining the compound R—O—O—H and induces the departure of a departing group X with lysis of the chemical bond between R and X. Compositions containing organic bleach activators from at least one compound from the group of compounds that form aliphatic peroxycarboxylic acids under perhydrolysis conditions are especially preferred as contemplated herein. It is especially preferable if the organic bleach activator is selected from at least one compound of the poly-N-acylated organic amines. The total amounts mentioned above also apply, mutatis mutandis, to these special organic bleach activators.

Of all the bleach activators known to those skilled in the art from the prior art, polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular, tetraacetylglycoluril (TAGU), N-acylimides, in particular N-nonanoylsuccinimide (NOSI), acylated phenol sulfonates, in particular n-nonanoyl or isononanoyloxybenzene sulfonate (n- and/or iso-NOBS) are especially preferably used. The total amounts listed above also apply, mutatis mutandis, to these special organic bleach activators.

The composition as contemplated herein most especially preferably contains as a bleaching block:

- from about 30% to about 70% by weight of at least one inorganic peroxide compound, in particular sodium percarbonate, and
- from about 10% to about 20% by weight of at least one organic bleach activator, from at least one compound from the group of compounds that form aliphatic peroxycarboxylic acids under perhydrolysis conditions.

The composition as contemplated herein of the first subject matter as contemplated herein necessarily contains a defined amount of hydrogen carbonate, calculated as sodium hydrogen carbonate. Most especially preferred sodium silicates include sodium metasilicate or water glass; water glass is in turn preferably used in the solid composition as contemplated herein.

As contemplated herein, bicarbonate is understood to be a chemical compound that contains at least one bicarbonate ion ($HCO_3$) prior to synthesis of the subject composition and which is different from the subject peroxide compounds. The amount of bicarbonate by weight in the subject composition is expressed by definition as the equivalent amount by weight of sodium bicarbonate.

Compositions containing bicarbonate in a total amount of from about 7.5 to about 30% by weight, calculated as sodium bicarbonate, based on the total weight of the composition are preferred as contemplated herein.

It is also preferred as contemplated herein to select bicarbonate from sodium bicarbonate, potassium bicarbonate or mixtures thereof. Sodium bicarbonate is most especially preferred as the bicarbonate as contemplated herein. It has also been found to be preferred in solving the problem as contemplated herein if the bicarbonate is present in particulate form, in particular as a powder or granules.

It is also preferable if the particles containing bicarbonate (for example, the powders or granule) have a bulk density of from about 0.40 to about 1.50 kg/dm$^3$, especially preferably with a bulk density of from about 0.90 to about 1.10 kg/dm$^3$ (for example, measured according to ISO 697). Within the scope of this preferred bulk density, it has proven to be especially preferred and advantageous if the particles containing the peroxide compound (for example, the powders or granules) have a bulk density of from about 0.70 to about 1.30 kg/dm$^3$, especially preferably a bulk density of from about 0.85 to about 1.20 kg/dm$^3$ (e.g., measured according to ISO 697).

A most especially preferred embodiment (A) of the subject solid composition is used. Each containing, based on the total weight of the solid composition, a total amount of

- from about 25% to about 70% by weight (in particular from about 35 to about 45% by weight) of at least one particulate (preferably inorganic) peroxide compound, in particular sodium percarbonate,
- from about 10% to about 20% by weight (in particular to about 15% by weight, from about 11 to about 18% by weight or from about 12 to about 16% by weight) of at least one organic bleach activator, in particular selected from at least one compound of the group of compounds that form aliphatic peroxycarboxylic acids under perhydrolysis conditions,
- from about 5% to about 50% by weight (in particular from about 7.5 to about 30% by weight) particulate hydrogen carbonate, calculated as sodium hydrogen carbonate, in particular sodium hydrogen carbonate granules, from 0 to about 5% by weight (preferably from 0 to about 4% by weight, especially preferably from 0 to about 3.5% by weight) surfactant, wherein the total amount of organic compound in the solid composition amounts to from about 10 to about 50% by weight, preferably from about 20 to about 35% by weight.

The subject composition necessarily contains a defined amount by weight of organic compound. It is especially preferred as contemplated herein if the subject composition contains, based on its total weight, organic compounds in a total amount of from about 20.0% by weight to about 35.0% by weight.

The technical effect is manifested in a particularly strong manner as contemplated herein if at least one organic compound containing at least one carbon atom is used.

Silicate with an oxidation number of the formula $(SiO_2)_n(Na_2O)_m$ with an average particle size (volume average) $X_{50.3}$ of +11 to −11 binds covalently to the at least one atom which is different from carbon and hydrogen.

According to the definition (see above), the organic bleach activator that is necessarily present falls under "organic compound."

As an organic compound, the compositions as contemplated herein preferably contain at least one organic antiredeposition agent as an organic compound as the additional ingredient. An antiredeposition agent is a chemical compound which prevents or restricts the redeposition of the dirt dispersed in the wash bath on the textile. The antiredeposition agent is necessarily at least a defined total amount of polysaccharide.

Within the context of a preferred embodiment, the polysaccharide is present in the form of particles (preferably as a powder or granules, especially preferably as granules). It is in turn preferred if these particles have an average particle size (volume average) $X_{50.3}$ of from about 200 to about 1600 μm, in particular of from about 300 to about 1400 μm, in particular of from about 400 to about 1200 μm, most especially preferably of from about 600 to about 1100 μm (for example, measured by screen analysis or by using a Camsizer particle size analyzer, Retsch).//chk//In a preferred embodiment, a polymeric compound having at least two anionic groups is present in the subject compositions as an organic anti-redeposition agent. Preferred anionic groups are selected from carboxylate, sulfonate, sulfate or cellulose and derivatives thereof, starch and derivatives thereof and mixtures.

In another embodiment, the subject solid composition contains at least one polysaccharide as the antiredeposition agent.

The liquid washing agent or cleaning agent preferably contains methyl cellulose, hydroxyethyl cellulose as the antiredeposition agent polysaccharide.

Preferred polysaccharides include celluloses and derivatives thereof, starch and derivatives thereof and mixtures thereof. As the polysaccharide, the solid composition as contemplated herein preferably contains methyl cellulose, ethyl cellulose, hydroxyethyl cellulose, hydroxypropyl cellulose, methyl hydroxyethyl cellulose, methyl carboxymethyl cellulose, ethyl hydroxyethyl cellulose, carboxymethyl cellulose (CMC), an ether sulfonic acid salt of starch, an ether sulfonic acid salt of cellulose, an acidic sulfuric acid ester salt of cellulose, an acidic sulfuric acid ester salt of starch or a mixture of at least two of these polysaccharides.

Carboxymethyl cellulose, in particular sodium carboxymethyl cellulose is most especially preferably present as the antiredeposition agent polysaccharide in the compositions as contemplated herein.

The preferred total amount of polysaccharide, in particular the preferred polysaccharide (see above) (especially preferably of carboxymethyl cellulose) is from about 1.5 to about 12.0% by weight, in particular from about 2.0 to about 10.0% by weight, most especially preferably from about 2.5 to about 9.5% by weight, each based on the weight of said composition.

In another preferred embodiment, the composition as contemplated herein additionally contains at least one soil-release active ingredient. Soil-release substances are often referred to as "soil-release" active ingredients or as "soil repellents" because of their ability to provide a soil repellant finish to the treated surface, for example, of the fibers. Copolyesters containing dicarboxylic acid units, alkylene glycol units and polyalkylene glycol units are especially effective soil-repellant active ingredients because of their chemical similarity to polyester fibers, but these may also manifest the desired effect on fabrics made of other materials. Soil-repellant polyesters of the aforementioned type as well as their use in washing agent have been known for a long time.

Thus, for example, polymers of ethylene terephthalate and polyethylene oxide terephthalate, in which the polyethylene glycol units have molecular weights of from about 750 to about 5000 and the molar ratio of ethylene terephthalate to polyethylene oxide terephthalate is 50:50 to 90:10 and the use thereof in washing agents are described in the German patent specification DE 28 57 292. Polymers with a molecular weight of from about 15,000 to about 50,000 from ethylene terephthalate and polyethylene oxide terephthalate, wherein the polyethylene glycol units have molecular weights of from about 1000 to about 10,000 and the molar ratio of ethylene terephthalate to polyethylene oxide terephthalate is from about 2:1 to about 6:1 may be used in washing agents according to the unexamined German patent application DE 33 24 258. European Patent EP 066 944 relates to textile treatment agents containing a copolyester of ethylene glycol, polyethylene glycol, aromatic dicarboxylic acid and sulfonated aromatic dicarboxylic acid in certain molar ratios. European Patent EP 185 427 discloses polyesters having methyl or ethyl group end caps with ethylene and/or propylene terephthalate and polyethylene oxide terephthalate units as well as washing agents containing such soil-release polymers. European Patent EP 241 984 relates to a polyester which also contains, in addition to ethylene oxide groups and terephthalic acid units, substituted ethylene units as well as glycerol units. European Patent EP 241 985 discloses polyesters which also contain, in addition to ethylene oxide groups and terephthalic acid units, 1,2-propylene, 1,2-butylene and/or 3-methoxy-1,2-propylene groups as well as glycerol units and with $C_1$ to $C_4$ alkyl group end group capping. European Patent EP 253 567 relates to soil-release polymers having a molecular weight of from about 900 to about 9000 from ethylene terephthalate and polyethylene oxide terephthalate wherein the polyethylene glycol units have molecular weights of from about 300 to about 3000 and the molar ratio of ethylene terephthalate to polyethylene oxide terephthalate is from about 0.6 to about 0.95. European Patent Application EP 272 033 discloses polyesters with polypropylene terephthalate and polyoxyethylene terephthalate units with proportional end group capping by $C_{1-4}$ alkyl or acyl radicals. European Patent EP 274 907 describes sulfoethyl end group-capped terephthalate-containing soil-release polyesters. European patent application EP 357 280 describes the production of soil-release polyesters with terephthalate, alkylene glycol and poly-$C_{2-4}$-glycol units produced by sulfonation of unsaturated end groups.

In an embodiment, the composition as contemplated herein contains at least one soil-release polyester containing the structural units I through III or I through IV:

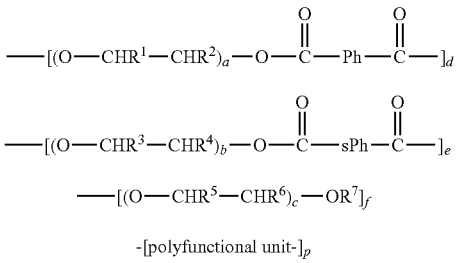

(I)

(II)

(III)

(IV)

in which a, b and c, independently of one another, each stand for a number from 1 to about 200, d, e and f, independently of one another, each stand for a number from 1 to about 50, g stands for a number from 0 to 5, Ph stands for a 1,4-phenylene radical, sPh stands for a 1,3-phenylene radical substituted in position 5 with an —$SO_3M$ group, M stands for Li, Na, K, Mg/2, Ca/2, Al/3, ammonium, mono-, di-, tri- or tetraalkylammonium, wherein the alkyl radicals of the ammonium ions are $C_1$-$C_{22}$ alkyl or $C_2$-$C_{10}$ hydroxyalkyl radicals or any mixture thereof, $R^1$, $R^2$, $R^3$, $R^4$, $R^5$ and $R^6$, independently of one another, each stand for hydrogen or a $C_1$-$C_{18}$ n- or isoalkyl group, $R^7$ stands for a linear or branches $C_1$-$C_{30}$ alkyl group or a linear or branched $C_2$-$C_{30}$ alkenyl group, for a cycloalkyl group with 5 to 9 carbon atoms, for a $C_6$-$C_{30}$ aryl group or for a $C_6$-$C_{30}$ arylalkyl group and "polyfunctional unit" stands for a unit with 3 to 6 functional groups capable of entering into an esterification reaction.

These preferably include polyesters, in which $R^1$, $R^2$, $R^3$, $R^4$, $R^5$ and $R^6$, independently of one another, each denotes hydrogen or methyl, $R^7$ stands for methyl, a, b and c, independently of one another, each stand for a number from 1 to about 200, in particular 1 to about 20, especially preferably 1 to 5, extremely preferably a and b=1 and c may be a number from 2 to 10, d is a number between 1 and about 25, in particular between 1 and 10, especially preferably between 1 and 5, e is a number between 1 and 30, in particular between 2 and 15, especially preferably between 3 and 10 and f is a number between about 0.05 and about 15, in particular between about 0.1 and about 10 and especially preferably between about 0.25 and about 3. Such polyesters can be obtained, for example, by polycondensation of terephthalic acid dialkyl esters, 5-sulfoisophthalic acid dialkyl esters, alkylene glycols, optionally polyalkylene glycols (in which a, b, and/or c>1) and polyalkylene glycols (corresponding to unit III) end-capped at one end. It should be pointed out that a polymeric backbone is present for numbers a, b, c>1 and thus the coefficients may assume any value within the given interval as the average value. This value reflects the number-average molecular weight. An ester of terephthalic acid with one or more difunctional aliphatic alcohols may be considered as unit (I) but ethylene glycol ($R^1$ and $R^2$ each stand for H) and/or 1,2-propylene glycol ($R^1$=H and $R^2$=—$CH_3$ or vice versa) and/or shorter-chain polyethylene glycols and/or polyethylene glycol-co-propylene glycol with number-average molecular weights of from about 100 to about 2000 g/mol are preferably used here. For example, 1 to 50 units (I) may be present per polymer chain in the structures. Examples of unit (II) that may be used include an ester of 5-sulfoisophthalic acid with one or more difunctional aliphatic alcohols, but those listed above are preferred for use here. For example, 1 to 50 units (II) may be present in the structures. The nonionic polyalkylene glycol monoalkyl ethers according to unit (III) that are capped at one end preferably include polyethylene glycol-co-propylene glycol monomethyl ethers with an average molecular weight of from about 100 to about 2000 g/mol and polyethylene glycol monomethyl ethers of general formula $CH_3$—O—$(C_2H_4O)_n$—H, where n=1 to 99, in particular 1 to 20 and especially preferably 2 to 10. By using such capped ethers capped at one end, the theoretical maximum average molecular weight to be achieved at complete conversion of a polyester structure is predetermined, so the preferred use amount of structural unit (III) is that which is necessary to achieve the average molecular weights given below. In addition to linear polyesters, which result from the structural units (I), (II) and (III), use of crosslinked or branched polyester structures is also as contemplated herein. This is expressed by the presence of a polyfunctional structure unit (IV), which has a crosslinking effect and has at least three up to at most six functional groups capable of entering into an esterification reaction. Functional groups that can be mentioned here include, for example, acid, alcohol, ester, anhydride or epoxy groups. Various functionalities are also possible in one molecule. Examples of this may include citric acid, malic acid, tartaric acid and gallic acid, especially preferably 2,2-dihydroxymethylpropionic acid. In addition, polyvalent alcohols such as pentaerythritol, glycerol, sorbitol and/or trimethylolpropane may be used. These may also be polyvalent aliphatic or aromatic carboxylic acids such as benzene-1,2,3-tricarboxylic acid (hemimellitic acid), benzene-1,2,4-tricarboxylic acid (trimellitic acid) or benzene-1,3,5-tricarboxylic acid (trimesic acid). The amount by weight of crosslinking monomers based on the total mass of the polyester may be up to about 10% by weight, in particular up to about 5% by weight and especially preferably up to about 3% by weight. The polyesters containing structural units (I), (II) and (III) and optionally (IV) have in general number-average molecular weights in the range of from about 700 to about 50,000 g/mol, wherein the number-average molecular weight can be determined by means of size exclusion chromatography in aqueous solution using calibration with the help of polyacrylic acid sodium salt standards having a narrow distribution. The number-average molecular weights are preferably in the range of from about 800 to about 25,000 g/mol, in particular from about 1000 to about 15,000 g/mol, especially preferably from about 1200 to about 12,000 g/mol. As contemplated herein, solid polyesters having softening points above 40° C. are preferably used as components of the particle of the second type. They preferably have a softening point between about 50 and about 200° C., especially preferably between about 80° C. and about 150° C. and extraordinarily preferably between about 100° C. and about 120° C. The polyesters can be synthesized by known methods, for example, by first heating the aforementioned components at normal pressure with the addition of a catalyst and then building up to the required molar weights in vacuo by distilling off excess amounts of the starting glycols above the stoichiometric amount. The known transesterification catalysts and condensation catalysts such as titanium tetraisopropylate, dibutyltin oxide, alkali or alkaline earth metal alcoholates or antimony trioxide/calcium acetate are suitable for the reaction. For additional details, reference is made to European Patent EP 442 101.

Polyesters that are preferred for use had a solid consistency and can easily be ground into powders or compacted and/or agglomerated to form granules of a defined particle size. The granulation may take place in such a way that the copolymers obtained by synthesis as a melt are solidified to form flakes by cooling in a cool gas stream, for example, a stream of air or nitrogen or by application to a flaking roller or to a running belt. This coarse material may optionally be milled further, for example, in a roll mill or in a screen mill which may be connected to a screening and a rounding as described above. The granulation may also take place in such a way that the polyesters are milled to powder after solidification and are then reacted by compacting and/or agglomeration and the rounding described above to form granules with defined particle sizes.

In an embodiment, the composition as contemplated herein additionally contains at least one enzyme. In principle all enzymes established in the state of the art for treatment of textiles can be used. There are preferably one or more enzymes that can manifest a catalytic activity in a washing agent in particular a protease, amylase, lipase, cellulase, hemicellulase, mannanase, pectin-cleaving enzyme, tannases, xylanase, xanthanase, β-glucosidase, carrageenase, perhydrolase, oxidase, oxidoreductase as well as mixtures thereof. Preferred suitable hydrolytic enzymes include in particular proteases, amylases in particular α-amylases, cellulases, lipases, hemicellulases in particular pectinases, mannanases, β-glucanases as well as mixtures thereof. Especially preferred are proteases, amylases and/or lipases as well as mixtures thereof and most especially preferred are proteases. These enzymes are in principle of natural origin. Starting from the natural molecules, improved variants which can preferably be used accordingly are available for use in washing agents or cleaning agents.

Under the proteases, those of the subtilisin type are preferred. Examples of these include the subtilisins BPN' and Carlsberg, the protease PB92, the subtilisins 147 and 309, the alkaline protease from *Bacillus lentus*, subtilisin DY and the subtilases, but not the enzymes thermitase, proteinase K and the proteases TW3 and TW7 which are to be assigned to the subtilisins in the narrower sense. Subtilisin Carlsberg is available in a further developed form under the brand names Alcalase® from the company Novozymes A/S, Bagsvaerd, Denmark. Subtilisins 147 and 309 are distributed by the company Novozymes under the brand names Esperase® and/or Savinase®. The protease variants carried under the brand name BLAP® are derived from the protease from *Bacillus lentus* DSM 5483. Additional usable proteases include, for example, those available under the brand names Durazym®, Relase®, Everlase®, Nafizym®, Kannase® and Ovozyme® from the company Novozymes, those available under the brand names Purafect®, Purafect® OxP, Purafect® Prime, Excellase® and Properase® from the company Genencor, the enzyme available under the brand name Protosol® from the company Advanced Biochemicals Ltd. of Thane, India, the enzyme available under the brand name Wuxi® from the company Wuxi Snyder Bioproducts Ltd., China, the enzymes available under the brand names Proleather® and Protease P® from the company Amano Pharmaceuticals Ltd., Nagoya, Japan and the enzyme available under the brand name Proteinase K-16 from the company Kao Corp., Tokyo, Japan. The proteases from *Bacillus gibsonii* and *Bacillus pumilus* are also especially preferred for use here.

Examples of amylases that may be used as contemplated herein include the α-amylases from *Bacillus licheniformis*, from *B. amyloliquefaciens* or from *B. stearothermophilus* as well as their improved further refinements for use in washing agents or cleaning agents. The enzyme from *B. licheniformis* is available from the company Novozymes under the name Termamyl® and from the company Genencor under the name Purastar® ST. Further developed products of these α-amylases are available under the brand names Duramyl® and Termamyl® Ultra from the company Novozymes, under the name Purastar® OxAm from the company Genencor and as Keistase® from the company Daiwa Seiko, Inc., Tokyo, Japan. The α-amylase from *B. amyloliquefaciens* is distributed under the name BAN® by the company Novozymes, and derived variants of α-amylase from *B. stearothermophilus* are distributed under the names BSG® and Novamyl®, also by the company Novozymes. In addition, the α-amylase from *Bacillus* sp. A 7-7 (DSM 12368) and the cyclodextrin glucanotransferase (CGTase) from *B. agaradherens* (DSM 9948) should be emphasized for this purpose. Likewise, fusion products of all the aforementioned molecules can be used. In addition, the further developments of α-amylase from *Aspergillus niger* and *A. oryzae*, which are available under the brand name Fungamyl® from the company Novozymes, are also suitable. Other commercial products that can also be used to advantage include, for example, amylase-LT® and Stainzyme® or Stainzyme Ultra® or Stainzyme Plus®, the latter also available from Novozymes. Variants of these enzymes available by point mutations may also be used as contemplated herein.

Examples of lipases or cutinases that may be used as contemplated herein and are present in particular because of their triglyceride-cleaving activities but also in order to create peracids in situ from suitable precursors include the lipases that are obtainable and/or have been further developed from *Humicola lanuginose* (*Thermomyces lanuginosus*), in particular those with the amino acid exchange D96L. They are distributed under the brand names Lipolase®, Lipolase® Ultra, LipoPrime®, Lipozyme® and Lipex®, for example, by the company Novozymes. In addition, for example, the cutinases that were originally isolated from *Fusarium solanii* and *Humicola insolens* can also be used. Suitable lipases also include those that can be obtained from the company Amano under the brand names Lipase CE®, Lipase P®, Lipase B® and/or Lipase CES®, Lipase AKG®, *Bacillus* sp. Lipase®, Lipase AP®, Lipase M-AP® and Lipase AML®. For example, the lipases and/or cutinases, whose starting enzymes were originally isolated from *Pseudomonas mendocina* and *Fusarium solanii* by the company Genencor, can also be used. The preparations M1 Lipase® and Lipoma® distributed by the company Gist-Brocades and the enzymes distributed under the names Lipase MY-30®, Lipase OF® and Lipase PL® by the company Meito Sangyo KK, Japan should also be mentioned as well as the product Lumafast® from the company Genencor.

Cellulases may be present as pure enzymes, as enzyme preparations or in the form of mixtures, depending on the purpose, in which the individual components advantageously supplement one another with regard to their various performance aspects. These performance aspects include in particular the contributions of cellulase to the primary washing performance of the agent (cleaning performance), regarding the secondary washing performance of the agent (antiredeposition effect or graying inhibition) for the finish (fabric effect) or to have a "stonewashed" effect. A usable fungal cellulase preparation with a high endoglucanase (EG) content and/or further developments thereof is offered by the company Novozymes under the brand name Celluzyme®. The products Endolase® and Carezyme®, which can also be obtained from the company Novozymes, are based on the 50 kD EG and/or the 43 kD EG from *H. insolens* DSM 1800. Additional commercial products from this company that can also be used include Cellusoft®, Renozyme® and Celluclean®. In addition, for example, the 20 kD EG from *Melanocarpus* available from the company AB Enzymes in Finland under the brand names Ecostone® and Biotouch® can also be used. Additional commercial products from the company AB Enzymes include Econase® and Ecopulp®. Other suitable cellulases are CBS 670.93 and CBA 669.93 from *Bacillus* sp., where the CBS 670.93 from *Bacillus* sp. is available from the company Genencor under the brand name Puradax®. Additional commercial products from the company Genencor include "Genencor detergent cellulase L" and IndiAge® Neutra. Variants of these enzymes obtainable by point mutations can also be used as contemplated herein. Especially preferred cellulases include *Thielavia terrestris* cellulase variants, cellulases from *Melanocarpus*, in particular *Melanocarpus albomyces*, cellulases from EGIII type from *Trichoderma reesei* or variants obtainable therefrom.

Furthermore, additional enzymes that can be summarized under the heading hemicellulases can also be used to remove certain problem stains. These include, for example, mannanases, xanthanlyases, xanthanases, xyloglucanases, xylanases, pullulanases, pectin-cleaving enzymes and β-glucanases. The β-glucanase obtained from *Bacillus subtilis* is available under the brand name Cereflo® from the company Novozymes. Especially preferred hemicellulases as contemplated herein include mannanases which are distributed, for example, under the brand names Mannaway® by the Novozymes company or Purabrite® by the Genencor company. The pectin-cleaving enzymes are also included as enzymes within the scope of the present disclosure under the names pectinase, pectate lyase, pectin esterase, pectin demethoxylase, pectin methoxylase, pectin methyl esterase, pectase, pectin methyl esterase, pectinoesterase, pectin pectyl hydrolase, pectin depolymerase, endopolygalacturonase, pectolase, pectin hydrolase, pectin polyglacturonase, endopolyglacturonase, poly-α-1,4-galacturonide, glycanohydrolase, endogalacturonase, endo-D-galacturonase, galacturan 1,4-α-galacturonidase, exopolygalacturonase, poly(galacturonate) hydrolase, exo-D-galacturonase, exo-D-galacturonase, exopoly-D-galacturonase, exopoly-α-galacturonosidae, exopolygalacturonosidase or exopolygalacturanosidase. Examples of suitable enzyme sin this regard are available under the brand names Gamanase®, Pektinex AR®, X-Pect® or Pectaway® from the Novozymes company, under the brand names Rohapect UF®, Rohapect TPL®, Rohapect PTE100®, Rohapect MPE®, Rohapect MA plus HC, Rohapect DA12L®, Rohapect 10L®, Rohapect B1L® from AB Enzymes and under the brand name Pyrolase® from Diversa Corp., San Diego, Calif., USA.

Of all these enzymes, those that are comparatively stable with respect to oxidation or have been stabilized by point mutagenesis, for example, are especially preferred. These include in particular the commercial products Everlase® and Purafect® OxP already mentioned above as examples of such proteases and Duramyl® as an example of such an α-amylase.

The compositions as contemplated herein contain enzymes preferably in total amounts of from about 1×10-8 to about 5% by weight, based on active protein. The enzymes are preferably present in these agents in a total amount of from about 0.001% to about 2% by weight, more preferably from about 0.01% to about 1.5% by weight, even more preferably from about 0.05% to about 1.25% by weight and especially preferably from about 0.01% to about 0.5% by weight, each based on active protein.

In addition, organic surfactants, organic builders, organic chelating agents, organic optical brighteners, organic pH control agents, perfume, organic coloring agents, organic dye transfer inhibitors or mixtures thereof may also be present as additional ingredients in the composition as contemplated herein.

All surfactants known for treatment of textiles can be used as suitable surfactants. However, the composition as contemplated herein should preferably be used as an additive within the scope of a textile washing. For this reason, the composition as contemplated herein necessarily contains from 0% to about 5% by weight surfactant (i.e., from no surfactant up to max. about 5% by weight surfactant), preferably from 0% to about 4% by weight, especially preferably from 0% to about 3.5% by weight surfactant.

If the composition as contemplated herein should additionally contain a surfactant, then it is preferable to use soap as the surfactant. Soaps are water-soluble sodium or potassium salts of saturated and unsaturated fatty acids with 10 to 20 carbon atoms, Of the resinic acids of colophony (yellow resin soaps) and of naphthenic acids, which are used as solid or semisolid mixtures mainly for washing and cleaning purposes. Sodium or potassium salts of saturated and unsaturated fatty acid with 10 to 20 carbon atoms, in particular with 12 to 18 carbon atoms, are preferred soaps as contemplated herein. Especially preferred compositions as contemplated herein are characterized in that they contain—based on their weight—from about 0.1% to about 5.0% by weight especially preferably from about 0.5% to about 4.5% by weight most especially preferably from about 1.0% to about 3.0% by weight soap(s).

It is preferred as contemplated herein if the subject solid compositions do not contain any nonionic surfactant.

Organic builders, which may be present in the composition as contemplated herein, are, for example, the polycarboxylic acids that can be used in the form of their sodium salts, wherein polycarboxylic acids are understood to be those carboxylic acids which have more than one acid function. For example, these include citric acid, adipic acid, succinic acid, glutaric acid, malic acid, tartaric acid, maleic acid, fumaric acid, sugar acids, aminocarboxylic acids as well as mixtures of these. Preferred salts include the salts of polycarboxylic acids, such as citric acid, adipic acid, succinic acid, glutaric acid, tartaric acid, sugar acids and mixtures of these.

Suitable builders also include polymeric polycarboxylates, which are, for example, the alkali metal salts of polyacrylic acid or polymethacrylic acid, for example, those with a relative molecular weight of from about 600 to about 750,000 g/mol.

Suitable polymers include in particular polyacrylates which preferably have a molecular weight of from about 1000 to about 15,000 g/mol. Because of their superior solubility, the short-chain polyacrylates having molecular weights of from about 1000 to about 10,000 g/mol and especially preferably from about 1000 to about 5000 g/mol are in turn preferred from this group.

Also suitable are copolymeric polycarboxylates, in particular those of acrylic acid with methacrylic acid and acrylic acid or methacrylic acid with maleic acid. To improve the water solubility, the polymers may also contain alkylsulfonic acids such as allyloxybenzene sulfonic acid and methallyl sulfonic acid as monomers.

An organic optical brightener is preferably selected from the substance classes of distyrylbiphenyls, stilbenes, 4,4'-diamino-2,2'-stilbenedisulfonic acids, coumarins, dihydroquinolinones, 1,3-diarylpyrazolines, naphthalic acid imides, the benzoxazole systems, the benzisoxazole systems, the benzimidazole systems, the pyrene derivatives substituted by heterocycles and mixtures thereof.

Especially preferred organic optical brighteners include disodium-4,4'-bis-(2-morpholino-4-anilino-s-trizin-6-ylamino)stilbenedisulfonate (obtainable, for example, as Tinopal® DMS from BASF SE), disodium-2,2'-bis-(phenylstyryl)disulfonate (obtainable, for example, as Tinopal® CBS from BASF SE), 4,4'-bis[(4-anilino-6-[bis(2-hydroxyethyl)amino]-1,3,5-triazin-2-yl)amino]stilbene-2,2'-disulfonic acid (obtainable, for example, as Tinopal® UNPA from BASF SE), hexasodium-2,2'[vinylene-bis[(3-sulfonato-4,1-phenylene)imino[6-(diethylamino)-1,3,5-triazine-4,2-diyl]imino]]bis-(benzene-1,4-disulfonate) (obtainable, for example, as Tinopal® SFP from BASF SE), 2,2'-(2,5-thiophendiyl)bis[5-1,1-dimethylethyl]benzoxazole (obtainable, for example, as Tinopal® SFP from BASF SE) and/or 2,5-bis(benzoxazol-2-yl)thiophene.

It is preferable for the organic dye transfer inhibitor to be a polymer or copolymer of cyclic amines such as, for example, vinylpyrrolidone and/or vinylimidazole. Polymers suitable for use as dye transfer inhibitors include polyvinylpyrrolidone (PVP), polyvinylimidazole (PVI), copolymers of vinylpyrrolidone and vinylimidazole (PVP/PVI), polyvinylpyridine N-oxide, poly-N-carboxymethyl-4-vinylpyridium chloride, polyethylene glycol-modified copolymers of vinylpyrrolidone and vinylimidazole as well as mixtures thereof. Especially preferred are polyvinylpyrrolidone (PVP), polyvinylimidazole (PVI) or copolymers of vinylpyrrolidone and vinylimidazole (PVP/PVI) as dye transfer inhibitors. The vinylpyrrolidones (PVP) that are used preferably have an average molecular weight of from about 2500 to about 400,000 and are available commercially from ISP Chemicals as PVP K 15, PVP K 30, PVP K 60 or PVP K 90 or from BASF as Sokalan® HP 50 or Sokalan® HP 53. The copolymers of vinylpyrrolidone and vinylimidazole (PVP/PVI) that are used preferably have a molecular weight in the range of from about 5000 to about 100,000. A PVP/PVI copolymer is available commercially from BASF under the brand name Sokalan® HP 56. Another highly preferred dye transfer inhibitor that can be used includes polyethylene glycol-modified copolymers of vinylpyrrolidone and vinylimidazole, which are obtainable from BASF under the brand name Sokalan® HP 66, for example.

It is most especially preferred if the composition as contemplated herein contains at least the following organic compounds within the scope of an embodiment (B) in a total amount of from about 0.2% to about 12.0% by weight, in particular of from about 1.0 to about 10.0% by weight, most especially preferably from about 2.5 to about 9.5% by weight of at least one antiredeposition polysaccharide (preferably carboxymethylcellulose) and from about 7.5% to about 30% by weight.

In a total amount of from about 10 to about 20% by weight, in particular from about 10 to about 15%, by weight of at least one organic bleach activator, and soap in a total amount of from 0 to about 4.5% by weight, in particular from about 1.0 to about 4.0% by weight, and in a total amount of from 0 to about 1.0% by weight of at least one enzyme (amount based on active protein), wherein the composition as contemplated herein contains a total amount of from about 12.7% by weight to about 50.0% by weight, in particular from about 20.0% by weight to about 35.0% by weight, organic compounds.

It is most especially preferred if, within the scope of one embodiment (C), the composition as contemplated herein contains, based on the weight of the composition, at least the following organic compounds:

- in a total amount of from about 0.2 to about 12.0% by weight, in particular of from about 1.0 to about 10.0% by weight, most especially preferably of from about 2.5 to about 9.5% by weight, of at least one polysaccharide as an antiredeposition agent (preferably carboxymethyl cellulose) and
- in a total amount of from about 0.1 to about 5.0% by weight, in particular of from about 0.5 to about 4.0% by weight, at least one dirt-release polyester containing structural units I to III or I to IV, in which a, b and c independently of one another each stand for a number from 1 to about 200, d, e and f independently of one another each stand for a number from 1 to about 50, g stands for a number from 0 to 5, Ph stands a 1,4-phenylene radical sPh stands for a 1,3-phenylene radical substituted in position 5 with an —$SO_3M$ group, M stands for Li, Na, K, Mg/2, Ca/2, Al/3, ammonium, mono-, di-, tri- or tetraalkylammonium, wherein the alkyl radicals of the ammonium ions are $C_1$-$C_{22}$ alkyl or $C_2$-$C_{10}$ hydroxyalkyl radicals or any mixtures thereof, $R^1$, $R^2$, $R^3$, $R^4$, $R^5$ and $R^6$ independently of one another each stand for hydrogen or a $C_1$-$C_{16}$ n- or isoalkyl group, R' stands for a linear or branched $C_1$-$C_{30}$ alkyl group or a linear or branched $C_2$-$C_{30}$ alkenyl group, for a cycloalkyl group with 5 to 9 carbon atoms, for a $C_6$-$C_{30}$ aryl group or for a $C_6$-$C_{30}$ arylalkyl group and "polyfunctional unit" stands for a unit with 3 to 6 functional groups capable of entering into an esterification reaction, and

- in a total amount of from about 10 to about 20% by weight, in particular from about 10 to about 15% by weight of at least one organic bleach activator and
- in a total amount of from 0 to about 4.5% by weight, in particular from about 1.0 to about 4.0% by weight soap and
- in a total amount of from 0 to about 1.0% by weight of at least one enzyme (amount based on active protein), wherein the composition as contemplated herein contains a total amount of from about 12.8% by weight to about 50.0% by weight, in particular from about 20.0% by weight to about 35.0% by weight, of organic compounds.

Within the scope of one embodiment, the combination of embodiment (A) (see above) with one of the embodiments (B) or (C) (see above) can be mentioned.

It is also preferred within the scope of another embodiment if the solid composition as contemplated herein contains, based on its total weight of solid basic silicate (calculated as water glass) in a total amount of at most about 20.0% by weight, in particular at most about 15.0% by weight, most especially preferably the composition as contemplated herein is free of solid basic silicate and a bulk density of from about 0.85 to about 1.20 kg/dm$^3$ (each measured according to ISO 697).

The solid composition as contemplated herein is produced by mixing the raw materials. A batch process or a continuous mixing process may be used here. It is preferred as contemplated herein to use such mixing processes in which the particles of the ingredient (for example, of the powder or of the granules) are not destroyed mechanically. Suitable mixing equipment for this purpose includes in particular tumble mixers, paddle mixers (Forberg, Lödige, Gericke companies) or helix mixers (Amixon, Gebrüder Ruberg companies). The ingredients of the solid composition as contemplated herein are mixed with a low energy input, using in particular mixing tools that mix at a circumferential speed of from 0.1 to 5 m/s.

The solid composition of the first subject matter is excellently suited for finishing in a water-soluble portion. The solid composition as contemplated herein of the first subject matter as contemplated herein is present in said portion in a chamber formed by a water-soluble material. The water-soluble material forms walls in the chamber and thereby encloses the composition as contemplated herein of the first subject matter as contemplated herein.

A second subject matter as contemplated herein is therefore a portion for use in treatment of textiles comprising at least one chamber having walls of water-soluble material, wherein a composition of the first subject matter as contemplated herein is contained in this at least one chamber.

A portion is an independent dosing unit with at least one chamber, which contains the substance to be dosed. A chamber is a space bordered by walls (for example, by a film), which can exist even without the substance to be dosed (optionally with a change in its form). A layer of a surface coating explicitly does not fall under the definition of a wall.

The walls of the chamber are made of a water-soluble material. The water solubility of the material can be determined with the help of a square film of said material (film 22×22 mm with a thickness of 76 μm) affixed in a square frame (edge length on the inside: 20 mm). Said framed film is then immersed in 800 mL distilled water heated to 20° C. in a 1 liter glass beaker having a circular bottom surface (Schott, Mainz, 1000 mL glass beaker, low form), so that the area of the film clamped is arranged at a wide angle to the bottom surface of the glass beaker while the top edge of the frame is 1 cm beneath the surface of the water and the bottom edge of the frame is oriented parallel to the bottom surface of the glass beaker such that the bottom edge of the frame runs along the radius of the bottom surface of the glass beaker and the center of the bottom edge of the frame is disposed above the center of the radius of the bottom of the glass beaker. The material should dissolve within about 600 seconds while stirring (stirring speed of the magnetic stirrer 300 rpm, stirring rod 6.8 cm long, diameter 10 mm), so that no single solid film particles are visible to the naked eye. The walls are preferably made of a water-soluble film. As contemplated herein this film may preferably have a thickness of max. about 150 μm (especially preferably of max. about 120 μm). Preferred walls are thus made of a water-soluble film and have a thickness of max. about 150 μm (especially preferably of max. about 120 μm, most especially preferably of max. about 90 μm).

The portion preferably contains the composition of the first subject matter as contemplated herein in a total amount of from about 4.0 to about 10.0 g, in particular of from about 5.0 to about 9.0 g.

If the composition of the first subject matter as contemplated herein is used as an additive to a washing agent, in particular a liquid washing agent, then it is preferable as contemplated herein if the composition of the first subject matter as contemplated herein is supplied in a water-soluble portion for use in the treatment of textiles comprising at least two chambers with walls made of a water-soluble material, characterized in that a) at least one of these chambers contains a first composition, wherein this first composition contains at least one surfactant and b) at least one additional one of these chambers contains a second composition, wherein this second composition is a solid composition of the first subject matter as contemplated herein.

It is again preferred if the first composition is liquid.

Anionic surfactants, cationic surfactants, amphoteric surfactants and nonionic surfactants may be used as the surfactant of the first composition. It is preferable as contemplated herein if the first composition of the portion contains at least one anionic surfactant and at least one nonionic surfactant.

Sulfonates and/or sulfates may preferably be used as the anionic surfactant. The anionic surfactant content is from about 5% to about 25% by weight and preferably from about 8 to about 20% by weight, each based on the total first or second liquid washing agent or cleaning agent with a low water content.

Preferred surfactants of the sulfonate type include $C_{9-13}$ alkylbenzene sulfonates, olefin sulfonates, i.e., mixtures of alkene and hydroxyalkane sulfonates as well as disulfonates such as those obtained, for example, from $C_{12-18}$ monoolefins with terminal or internal double bonds by sulfonation with gaseous sulfur trioxide and subsequent alkaline or acidic hydrolysis of the sulfonation products. Also suitable are $C_{12-18}$ alkanesulfonates and the esters of α-sulfofatty acids (ester sulfonates), for example, the α-sulfonated methyl esters of hydrogenated coconut fatty acids, palm kernel fatty acids or tallow fatty acids.

The alkali salts and in particular the sodium salts of the sulfuric acid hemiesters of the $C_{12}$-$C_{18}$ fatty alcohols, for example, those from coconut fatty alcohol, tallow fatty alcohol, lauryl, myristyl, cetyl or stearyl alcohol or $C_{10}$-$C_{25}$ oxo alcohols and the hemiesters of secondary alcohols of these chain lengths are preferred as the alk(en)yl sulfates. Of technical interest and washing are the $C_{12}$-$C_{16}$ alkyl sulfates and the $C_{12}$-$C_{15}$ alkyl sulfate as well as the $C_{14}$-$C_{15}$ alkyl sulfates are preferred. Also 2,3-alkyl sulfates are suitable anionic surfactants.

Fatty alcohol ether sulfates such as the sulfuric acid monoesters of linear or branched $C_{7-21}$ alcohols ethoxylated with 1 to 6 mol ethylene oxide are suitable such as 2-methyl-branched $C_{9-11}$ alcohols with an average of 3.5 mol ethylene oxide (EO) or $C_{12-18}$ fatty alcohols with 1 to 4 EO.

Other suitable anionic surfactants include soaps. Suitable examples include saturated and unsaturated fatty acid soaps, such as the salts of lauric acid, myristic acid, palmitic acid, stearic acid, (hydrogenated) erucic acid and behenic acid as well as in particular salt mixtures derived from natural fatty acids, for example, coconut, palm kernel, olive oil or tallow fatty acids.

The anionic surfactants as well as the soaps may be present in the form of their sodium, potassium or magnesium or ammonium salts. The anionic surfactants are preferably present in the form of their ammonium salts. Preferred counterions for the anionic surfactants are the protonated forms of choline, triethylamine, monoethanolamine or methyl ethyl amine.

In a most especially preferred embodiment, the first composition contains an alkylbenzene sulfonic acid neutralized with monoethanolamine, in particular $C_{9-13}$ alkylbenzene sulfonic acid and/or a fatty acid neutralized with monoethanolamine.

Suitable nonionic surfactants include alkoxylated fatty alcohols, alkoxylated fatty acid alkyl esters, fatty acid amides, alkoxylated fatty acid amides, polyhydroxy fatty acid amides, alkyl phenol polyglycol ethers, amine oxides, alkyl polyglucoside and mixtures thereof.

Alkoxylated, advantageously ethoxylated, in particular primary alcohols preferably with 8 to 18 carbon atoms and an average of 4 to 12 mol ethylene oxide (EO) per mol alcohol are preferably used as the nonionic surfactant, in which the alcohol moiety is linear or may preferably be methyl-branched in position 2 and/or may contain linear and methyl-branched moieties in the mixture such as how they are usually present in oxo alcohols radicals. In particular, however, alcohols ethoxylates with linear radicals from alcohols of native origin with 12 to 18 carbon atoms, for example, from coconut, palm and tallow fatty or oleyl alcohol and an average of 5 to 8 EO per mol alcohol are preferred in particular. The preferred ethoxylated alcohols include, for example, $C_{12-14}$ alcohols with 4 EO or 7 EO, $C_{9-11}$ alcohol with 7 EO, $C_{13-15}$ alcohols with 5 EO, 7 EO or 8 EO, $C_{12-18}$ alcohols with 5 EO or 7 EO and mixture thereof. The stated degrees of ethoxylation are statistical averages which may be a whole number or a fraction for a specific product. Preferred alcohol ethoxylates have a narrow homolog distribution (narrow range ethoxylates, NRE). In addition to these nonionic surfactants, fatty alcohols with more than 12 EO may also be used. Examples of these include tallow fatty alcohol with 14 EO, 25 EO, 30 EO or 40 EO. Nonionic surfactants containing EO and PO groups together in the molecule can also be used as contemplated herein. Also suitable is a mixture of a (more strongly) branch ethoxylated fatty alcohol and an unbranched ethoxylated fatty alcohol such as, for example, a mixture of a $C_{16-18}$ fatty alcohol with 7 EO and 2-propylheptanol with 7 EO. In particular, preferably the first composition contains a $C_{12-18}$ fatty alcohol with 7 EO, a $C_{13-15}$ oxo alcohol with 7 EO and/or a $C_{13-15}$ oxo alcohol with 8 EO as a nonionic surfactant.

The nonionic surfactant content is from about 1% to about 25% by weight and preferably from about 2% to about 20% by weight, each based on the total first composition.

The total amount of surfactant in the first composition is preferably up to about 85% by weight, preferably from about 40 to about 75% by weight and especially preferably from about 50% to about 70% by weight, each based on the total first composition.

It is preferable as contemplated herein if the first composition additionally contains at least one polyalkoxylated polyamine.

This polyalkoxylated polyamine within the scope of the present disclosure and its individual aspects relate to a polymer with a backbone containing an N atom which has polyalkoxy groups on the N atoms. At the ends (terminus and/or side chains) the polyamine has primary amino functions and in the interior it preferably has both secondary and tertiary amino functions. It may optionally have only secondary amino functions in the interior so that the result is a linear polyamine instead of a branched chain polyamine. The ratio of primary to secondary amino groups in the polyamine is preferably in the range of from about 1:0.5 to about 1:1.5, in particular in the range of from about 1:0.7 to about 1:1. The ratio of primary to tertiary amino groups in the polyamine is preferably in the range of from about 1:0.2 to about 1.1, in particular in the range of from about 1:0.5 to about 1:0.8. The polyamine preferably has an average molecular weight in the range of from about 500 g/mol to about 50,000 g/mol, in particular from about 550 g/mol to about 5000 g/mol. The N atoms in the polyamine are separated from one another by alkylene groups, preferably by alkylene groups with 2 to 12 carbon atoms, in particular 2 to 6 carbon atoms, wherein not all alkylene groups must have the same number of carbon atoms. Ethylene groups, 1,2-propylene groups, 1,3-propylene groups and mixture thereof are especially preferred. Polyamines having ethylene groups as said alkylene group are also known as polyethylene imine or PEI. PEI is a polymer with a backbone containing nitrogen atoms that is especially preferred as contemplated herein.

The primary amino functions in the polyamine may contain one or two polyalkoxy groups, and the secondary amino functions may have one polyalkoxy group wherein not all amino functions must have alkoxy group substituents. The average number of alkoxy groups per primary and secondary amino functions in the polyalkoxylated polyamine is preferably from 1 to 100, in particular from 5 to 50. The alkoxy groups in the polyalkoxylated polyamine are preferably polypropoxy groups, which are bound directly to nitrogen atoms and/or polyethoxy groups, which are bound to N atoms and propoxy groups that are optionally present and are bound to N atoms that do not have any propoxy groups.

Polyethoxylated polyamines are obtained by reacting polyamines with ethylene oxide (abbreviated EO). The polyalkoxylated polyamines containing ethoxy groups and propoxy groups are preferably accessible by reaction of polyamines with propylene oxide (abbreviated PO) and subsequent reaction with ethylene oxide.

The average number of propoxy groups per primary and secondary amino function in the polyalkoxylated polyamine is preferably from 1 to 40, in particular from 5 to 20.

The average number of ethoxy groups per primary and secondary amino function in the polyalkoxylated polyamine is preferably from 10 to 60, in particular from 15 to 30.

If desired, the terminal OH function as polyalkoxy substituents in the polyalkoxylated polyamine may be partially or completely etherified with a $C_1$-$C_{10}$ in particular $C_1$-$C_3$ alkyl group.

As contemplated herein, especially preferred polyalkoxylated polyamines may be selected from polyamine reacted with 45 EO per primary and secondary amino function, PEIs reacted with 43 EO per primary and secondary amino function, PEIs reacted with 15 EO+5 PO per primary and secondary amino function, PEIs reacted with 15 PO+30 EO per primary and secondary amino function, PEIs reacted with 5 PO+39.5 EO per primary and secondary amino function, PEIs reacted with 5 PO+15 EO per primary and secondary amino function, PEIs reacted with 10 PO+35 EO per primary and secondary amino function, PEIs reacted with 15 PO+30 EO per primary and secondary amino function and PEIs reacted with 15 PO+5 EO per primary and secondary amino function. PEI containing 10 to 20 nitrogen atoms, reacted with 20 units EO per primary or secondary amino function of the polyamine, is a most especially preferred alkoxylated polyamine.

Another subject matter as contemplated herein is the use of polyalkoxylated polyamines obtainable by reaction of polyamines with ethylene oxide and optionally additional propylene oxide. If polyamines polyalkoxylated with ethylene oxide and propylene oxide are used, then the amount of propylene oxide and the total amount of alkylene oxide is preferably from about 2 mol % to about 18 mol %, in particular from about 8 mol % to about 15 mol %.

The first composition contains, based on its total weight, polyalkoxylated polyamines, preferably in a total amount of from about 0.5 to about 10% by weight, in particular of from about 1.0 to about 7.5% by weight.

The first composition finished in the water-soluble portion in the first chamber may contain water, wherein the amount of water in particular for the first compositions, may be at most about 20% by weight, preferably at most about 15% by weight, based on the total first composition.

The first composition may contain additional ingredients which further improve the technical use properties and/or aesthetic properties of the first composition. Within the scope of the present disclosure, the first composition preferably additionally contains one or more substances from the group of builders, enzymes, electrolytes, pH adjusting agents, perfumes, perfume vehicles, fluorescent agents, coloring agents, hydrotopes, foam inhibitors, silicone oils, antiredeposition agents, graying inhibitors, shrinkage preventers, wrinkle-preventing agents, antimicrobial active ingredients, nonaqueous solvents, germicides, fungicides, antioxidants, preservatives, corrosion inhibitors, antistatics, bitter substances, ironing aids, water repellents and impregnation agents, skin care agents, swelling agents and anti-slip agents, softening components as well as UV absorbers.

The portion preferably contains the first composition in a total amount of from about 10.0 to about 20.0 g, in particular of from about 14.0 to about 18.0 g.

The portion necessarily includes water-soluble material to form the adjacent wall of the at least one chamber. The water-soluble material is preferably formed by a water-soluble film material.

Such water-soluble portions can be prepared either by methods of vertical mold filling sealing (VFFS) or by thermoforming methods.

The thermoforming method in general includes forming a first layer of a water-soluble film material to form at least one bulge to receive at least one composition therein, filling the composition into the respective bulge, covering the bulges filled with the composition using a second layer of a water-soluble film material and then sealing the first and second layers to one another at least around the bulges.

The water-soluble material preferably contains at least one water-soluble polymer. In addition, the water-soluble material preferably contains a water-soluble film material selected from polymers or polymer mixtures. The wrapping may be formed from one or two or more layers from the water-soluble film material. The water-soluble film material of the first layer and of the additional layers, if present, may be same or different.

It is preferable for the water-soluble material to contain polyvinyl alcohol or a polyvinyl alcohol copolymer.

Suitable water-soluble films as the water-soluble material are preferably based on a polyvinyl alcohol or a polyvinyl alcohol copolymer whose molecular weight is in the range of from about 10,000 to about 1,000,000 g/mol, preferably from about 20,000 to about 500,000 g/mol, especially preferably from about 30,000 to about 100,000 g/mol and in particular from about 40,000 to about 80,000 g/mol.

Polyvinyl alcohol is usually prepared by hydrolysis of polyvinyl acetate because the direct synthesis pathway is impossible. The same thing is also true of polyvinyl alcohol copolymers, which are synthesized from polyvinyl acetate copolymers accordingly. It is preferable if at least one layer of the water-soluble material includes a polyvinyl alcohol, whose degree of hydrolysis constitutes from about 70 to about 100 mol %, preferably from about 80 to about 90 mol %, especially preferably from about 81 to about 89 mol % and in particular from about 82 to about 88 mol %.

In addition, polymers selected from the group comprising acrylic acid-containing polymers, polyacrylamides, oxazoline polymers, polystyrene sulfonates, polyurethanes, polyesters, polyethers of polylactic acid and/or mixtures of the preceding polymers may also be added to the film material that is suitable for use as the water-soluble material.

Preferred polyvinyl alcohol copolymers include in addition to vinyl alcohol, dicarboxylic acids as additional monomers. Suitable dicarboxylic acids include itaconic acid, malonic acid, succinic acid and mixtures thereof, but itaconic acid is preferred.

Likewise, preferred polyvinyl alcohol copolymers include, in addition to vinyl alcohol, an ethylenically unsaturated carboxylic acid, its salt or ester. Such polyvinyl alcohol copolymers preferably contain, in addition to vinyl alcohol, in particular acrylic acid, methacrylic acid, acrylic acid esters, methacrylic acid esters or mixtures thereof.

Suitable water-soluble films for use as the water-soluble material of the water-soluble portion as contemplated herein include films that are distributed under the brand name MonoSol M8630 by MonoSol LLC. Other suitable films include films with the brand names Solublon® PT, Solublon® KA, Solublon® KC or Solublon® KL from Aicello Chemical Europe GmbH or the VF-HP films from Kuraray.

The aforementioned preferred embodiments of the first subject matter as contemplated herein are also preferred for the second composition contained in the water-soluble portion according to the first subject matter as contemplated herein.

The portion preferably contains the second composition in a total amount of from about 4.0 to about 10.0 g, in particular from about 5.0 to about 9.0 g.

In a third subject matter as contemplated herein, the use of a composition of the first subject matter as contemplated herein for treatment of textiles.

Within the scope of this use, it is preferred if the composition is fabricated in a water-soluble portion of the second subject matter as contemplated herein. Again, the embodiment form of a portion with at least two chambers is preferred, such as that described within the context of the second subject matter as contemplated herein.

A fourth subject matter as contemplated herein is a method for treatment of textiles containing the steps of dosing a composition of the first subject matter as contemplated herein to produce a wash liquor containing water and bringing the resulting wash liquor in contact with textiles.

The preferred embodiments described for the first and second subject matters as contemplated herein are also applicable, mutatis mutandis, for the third and fourth subject matters as contemplated herein.

The following points illustrate another embodiment as contemplated herein:

1. Solid composition for use in treatment of textiles, containing the following, each based on the total weight of the solid composition in a total amount of

- from about 30% to about 70% by weight of at least one peroxide compound,
- from about 10% to about 20% by weight of at least one organic bleach activator,
- from about 5% to about 50% by weight hydrogen carbonate, calculated as sodium hydrogen carbonate,
- from about 1% to about 50% by weight of at least one polysaccharide,
- from 0 to about 5% by weight surfactant Wherein the total amount of organic compound in the solid composition amounts to from about 10 to about 50% by weight, preferably from about 20 to about 35% by weight.

2. Composition according to point 1, characterized in that, based on the total weight of the composition, peroxide compounds are present in a total amount of from about 32 to about 55% by weight, in particular from about 33 to about 45% by weight.

3. Composition according to any one of points 1 or 2, characterized in that the peroxide compound is selected from sodium percarbonate, sodium perborate, sodium peroxodisulfate or mixtures thereof.

4. Composition according to any one of points 1 to 3, characterized in that the peroxide compound is sodium percarbonate.

5. Composition according to any one of points 1 to 4, characterized in that the peroxide compound is present as a powder or granules, preferably with a bulk density of from about 0.70 to about 1.30 kg/dm$^3$, especially preferably with a bulk density of from about 0.85 to about 1.20 kg/dm$^3$ (for example, each measured according to ISO 697).

6. Composition according to point 5, characterized in that the peroxide compound has an average grain size (volume average) $X_{50.3}$ of from about 0.40 to about 0.95 mm in particular of from about 0.40 to about 0.90 mm.

7. Composition according to any one of points 1 to 6, characterized in that the organic bleach activator is selected from at least one compound of the group of compounds that form aliphatic peroxycarboxylic acids under perhydrolysis conditions.

8. Composition according to any one of points 1 to 7, characterized in that the organic bleach activator is selected from at least one compound of the poly-N-acylated organic amines.

9. Composition according to any one of points 1 to 8, characterized in that hydrogen carbonate is present in a total amount of from about 7.5 to about 30% by weight, based on the total weight of the composition and calculated as sodium hydrogen carbonate.

10. Composition according to any one of points 1 to 9, characterized in that hydrogen carbonate is selected from sodium hydrogen carbonate, potassium hydrogen carbonate or mixtures thereof.

11. Composition according to any one of points 1 to 10, characterized in that the hydrogen carbonate is sodium hydrogen carbonate.

12. Composition according to any one of points 1 to 11, characterized in that the hydrogen carbonate is present as a powder or granules.

13. Composition according to any one of points 1 to 12, characterized in that the hydrogen carbonate has a bulk density of from about 0.4 to about 1.5 kg/dm$^3$, preferably with a bulk density of from about 0.9 to about 1.1 kg/dm$^3$ (each measured according to ISO 697).

14. Composition according to any one of points 1 to 13, characterized in that the organic bleach activator is present in a total amount of from about 5% to about 20% by weight, in particular from about 10% to about 15% by weight, based on the total weight of the composition.

15. Portion for use in treatment of textiles, comprising at least two chambers with walls made of a water-soluble material, characterized in that a) at least one of these chambers contains a first composition, this first composition containing at least one surfactant and b) at least one additional one of these chambers contains a solid composition according to any one of points 1 to 14.

16. Portion according to point 15, characterized in that the first composition is liquid.

17. Portion according to any one of points 15 or 16, characterized in that at least one anionic surfactant and at least one nonionic surfactant are contained in the first composition.

18. Portion according to any one of points 15 through 17, characterized in that, based on the weight of the first composition, the first liquid composition contains a surfactant in a total amount of up to about 85% by weight, preferably from about 40 to about 75% by weight and especially preferably from about 50 to about 70% by weight.

19. Portion according to any one of points 15 to 20, characterized in that the first composition contains, based on its total weight, at most about 20% by weight, in particular at most about 15% by weight water.

20. Portion according to any one of points 15 to 19, characterized in that the water-soluble material contains at least one water-soluble polymer.

21. Portion according to any one of points 15 to 20, characterized in that the first composition is present in an amount of from about 10.0 to about 20.0 g, in particular of from about 14.0 to about 18.0 g, and the second composition is present in an amount of from about 4.0 to about 10.0 g, in particular of from about 5.0 to about 9.0 g.

22. Use of a composition according to any one of points 1 to 14 for treatment of textiles.

23. Use according to point 22, characterized in that the composition is fabricated according to any one of points 1 to 14 in a portion corresponding to any one of points 15 to 21.

24. Method for treatment of textiles, comprising the steps of dosing a composition according to any one of points 1 to 14 for production of a wash liquor containing water and bringing the resulting wash liquor in contact with textiles.

EXAMPLES 1.0 Production of the Test Compositions

The following compositions of Tables 1 and 2 were prepared:

TABLE 1

| Solid composition (amounts in % by weight): | | |
|---|---|---|
| | V1 [wt %] | E1 [wt %] |
| Sodium percarbonate (granules) | 47.0 | 47.0 |
| TAED | 13.0 | 13.0 |
| Carboxymethyl cellulose | 6.0 | 6.0 |
| Sodium hydrogen carbonate | — | 10.2 |
| Sodium silicate [$(Na_2O)(SiO_2)_{2.5}$] | 10.2 | — |
| $C_{18}$ fatty acid soap | 3.0 | 3.0 |
| Enzymes (protease, lipase, amylase, mannanase) in granules of sodium sulfate | 10.7 | 10.7 |
| Sodium sulfate | to 100 | to 100 |

The sodium percarbonate granules were coated homogeneous with 6 g sodium sulfate according to a known method (WO 2008/012181 A1) and placed in a tumble mixer. Instead of this coated sodium percarbonate, 53.3% by weight sodium percarbonate Q35 (containing 88.18% by weight sodium percarbonate, Evonik Co.) were placed in the mixer. The remaining components were placed in the tumble mixer and the compositions were prepared by dry mixing the components for 3 minutes at 10 revolutions per minute.

TABLE 2

| Liquid composition: | |
|---|---|
| | L1 (wt %) |
| $C_{11-13}$ alkylbenzene sulfonic acid | 23.0 |
| $C_{13-15}$ alkyl alcohol ethoxylated with 8 mol ethylene oxide | 24.0 |
| Glycerol | 9.0 |
| 2-Aminoethanol | 6.8 |
| Ethoxylated polyethylene imine | 4.0 |
| $C_{12-18}$ fatty acid | 7.5 |
| Diethylenetriamine-N,N,N',N',N''-penta(methylenephosphonic acid), heptasodium salt (sodium DTPMP) | 3.5 |
| 1,2-Propylene glycol | 4.5 |
| Ethanol | 4.0 |
| Soil-release polymer from ethylene terephthalate and polyethylene oxide terephthalate | 1.0 |
| Perfume, dye | 1.7 |
| Water | to 100 |

In a stirred vessel, the components of the liquid composition were mixed together in order while stirring.

A portion P1 as contemplated herein was prepared, containing 8.5 g of the solid composition E1 from Table 1 and 16.5 g of the composition L1 from Table 2. To this end, a film M8630 from the company Monosol (90 μm) was stretched on a form with a double cavity. The stretched film was heated for a period of 2400 ms at 105° C. and then drawn into the cavity by a vacuum. Next a corresponding amount of the solid composition of Table 1 was preweighed and filled into the cavity and then the amount of liquid composition L1 from Table 2 was added to the second cavity by means of a syringe. Then a cover film (M8630, 90 μm) was placed on the cavities to seal them and welded to the first film by applying heat (150° C., 1000 ms). After breaking the vacuum, each portion was removed from a cavity. After that, one wall of the powder chamber of the portion was perforated with a needle. Therefore, excess air escaped from the powder chamber of the portion and the film of the wall relaxed.

2.0 Storage Test at 55° C.

325 g of a solid composition was placed in a Dewar vessel with a temperature measuring probe. The sample was then heated to 55° C. and stored in a heating cabinet. The temperature of the solid composition in the Dewar vessel was measured for a storage time of 250 h at 55° C. and the results were plotted as a function of the storage time. This experiment was carried out using the compositions E1 and V1 from Table 1.

The solid composition V1 that is not as contemplated herein underwent extreme spontaneous decomposition in which the sample was heated to more than 61° C. within 100 h and to 180° C. after 140 h. The temperature of the spontaneously accelerating decomposition (SADT) of the solid composition V1 was reached in storage at 55° C.

The composition E1 as contemplated herein was unremarkable and stable over the entire storage time of 250 h. The temperature of spontaneously accelerating decomposition (SADT) of the solid composition E1 was never reached.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A solid composition for use in treatment of textiles comprising:

a sodium percarbonate present as a powder or granules in a total amount of about 32% to about 55% by weight based on the total weight of the composition, tetraacetylethylenediamine present in a total amount of from about 10% to about 20% by weight based on the total weight of the composition, a sodium hydrogen carbonate present as a powder or granules in a total amount of from about 7.5 to about 30% by weight based on the total weight of the composition, and a surfactant present in a total amount of from about 1 to about 3% by weight based on a total weight of the composition, wherein the total amount of organic compound in the solid composition amounts to from about 10% to about 50% by weight, and wherein the solid composition is free of sodium silicate.

2. The composition according to claim 1, wherein the sodium percarbonate has an average grain size (volume average) $X_{50,3}$ of from about 0.40 to about 0.95 mm.

3. A dosing unit for use in treatment of textiles, wherein the dosing unit comprises at least two chambers with walls made of a water-soluble material, and wherein a) at least one of the chambers includes a first composition, the first composition comprising at least one surfactant, and b) at least one additional one of the chambers includes a second composition comprising, each based on the total weight of the second composition, a total amount of:

from about 32% to about 55% by weight of sodium percarbonate, from about 10% to about 20% by weight tetraacetylethylenediamine, from about 7.5% to about 30% by weight of sodium hydrogen carbonate, from about 1% to about 3% by weight of a surfactant, wherein the total amount of organic compound in the second composition amounts to from about 10% to about 50% by weight; and wherein the second composition is free of sodium silicate.

4. A method for treatment of textiles wherein the method comprises the steps of:

dosing a composition for producing a wash liquor that comprises water, wherein the composition further comprises, each based on the total weight of the composition, a total amount of:

from about 32% to about 55% by weight of sodium percarbonate, from about 10% to about 20% by weight traacetylethylenediamine, from about 7.5% to about 30% by weight of a hydrogen carbonate, from about 1% to about 3% by weight of a surfactant, wherein the total amount of organic compound in the composition amounts to from about 10% to about 50% by weight, and the composition is free of sodium silicate;

and bringing the resulting wash liquor in contact with the textiles.

5. The composition of claim 1, wherein the total amount of organic compound in the solid composition amounts to from about 20% to about 35% by weight.

6. The composition according to claim 1, wherein, based on the total weight of the composition, the sodium percarbonate is present in a total amount of about 47% by weight.

7. The composition according to claim 1, wherein the sodium percarbonate has a bulk density of from about 0.70 to about 1.30 $kg/dm^3$.

8. The composition according to claim 7, wherein the sodium percarbonate has a bulk density of from about 0.85 to about 1.20 $kg/dm^3$.

9. The composition according to claim 1, wherein the sodium percarbonate has an average grain size (volume average) $X_{50.3}$ of from about 0.50 to about 0.90 mm.

10. The composition according to claim 1, wherein the sodium hydrogen carbonate has a bulk density of 0.9 to 1.1 $kg/dm^3$ as measured according to ISO 697.

* * * * *